United States Patent [19]

Focke et al.

[11] Patent Number: 4,931,633

[45] Date of Patent: Jun. 5, 1990

[54] PACKAGING MACHINE FOR CIGARETTES WITH SHAFT WALL MOUNTED SENSORS

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 124,517

[22] Filed: Nov. 24, 1987

[30] Foreign Application Priority Data

Nov. 27, 1986 [DE] Fed. Rep. of Germany ..... 3640491

[51] Int. Cl.[5] ..... G01N 9/04

[52] U.S. Cl. ..... 250/223 R; 250/239

[58] Field of Search ..... 250/223 R, 239, 227; 209/536

[56] References Cited

U.S. PATENT DOCUMENTS 4,645,921 2/1987 Heitmann et al. ..... 209/536
4,678,901 7/1987 Focke et al. ..... 250/223

FOREIGN PATENT DOCUMENTS 2919579 12/1979 Fed. Rep. of Germany .
3243204 5/1984 Fed. Rep. of Germany .

*Primary Examiner*—David C. Nelms
*Attorney, Agent, or Firm*—Sughrue, Mion, Zinn, Macpeak & Seas

[57] ABSTRACT

Packaging machines for cigarettes are conventionally equipped with a (cigarette) magazine (11) which receives a stock of cigarettes (10). The lower region of the magazine (11) consists of a plurality of magazine shafts (12) which are divided off from one another by means of shaft walls (13). The cigarettes (10) are extracted at the lower ends of the magazine shafts (12) in groups each corresponding to the content of a cigarette pack, by being pushed out axially. In order to check the cigarettes for defective construction, especially for any gaps (16) in the tobacco in the region of the ends of the cigarettes (10), optoelectrical sensors, especially receivers (17, 18; 30, 31), are arranged in the shaft walls of appropriate thickness. These sensors are directed towards the side of the cigarettes (10) transversely relative to the longitudinal axis of these. Light entering from the end faces of the cigarettes (10) is received by the receivers (17, 18; 30, 31) and evaluated in terms of any gaps (16) in the tobacco. To generate the light, transmitters (19; 32) can be arranged on the end faces of the cigarettes (10) in the front wall (21) and/or rear wall (22) of the magazine (11). The magazine (11) equipped with test members in this way is suitable, in an especially simple and reliable way, for testing and separating out individual or extremely small groups of defective cigarettes.

14 Claims, 5 Drawing Sheets

Fig. 1
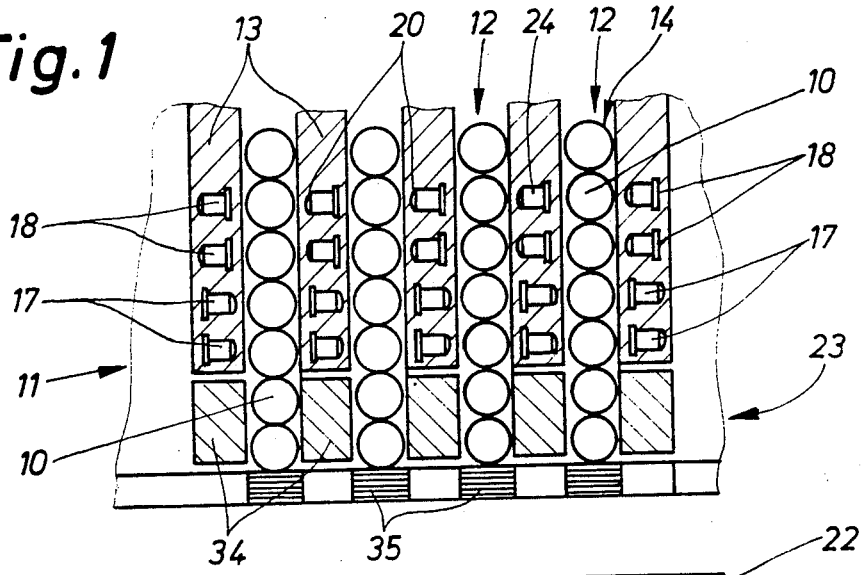
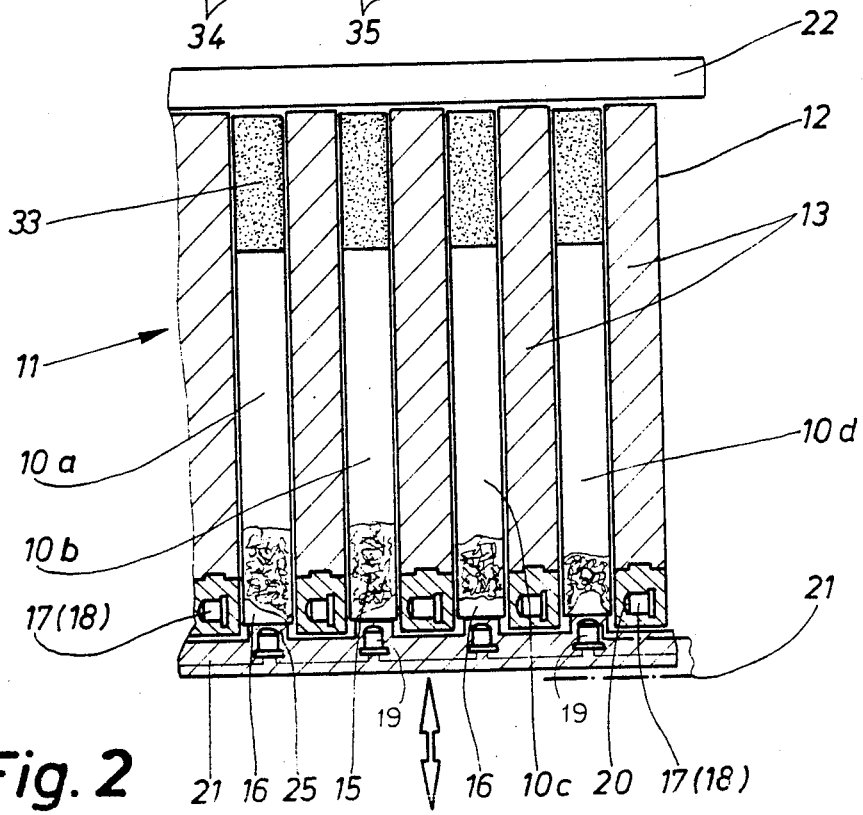
Fig. 2

PACKAGING MACHINE FOR CIGARETTES WITH SHAFT WALL MOUNTED SENSORS

BACKGROUND OF THE INVENTION

The invention relates to a packaging machine for cigarettes, with a container (magazine) for stocking the cigarettes, the magazine being subdivided, at least in the lower region, by means of shaft walls into magazine shafts, each for receiving a vertical row of cigarettes, and with test members for checking the cigarettes for a correct tobacco content, the presence of a filter, etc.

Cigarettes are checked for any errors before packaging. The main defects arise from an insufficient tobacco content which can cause deficiencies or voids above all at the ends, that is to say in the region of the end faces of the cigarettes. A check must also be made to ascertain whether, on filter cigarettes, a filter is present and is properly attached.

A packaging machine for cigarettes conventionally has assigned to it a magazine which receives a certain stock of aligned cigarettes. In the magazine, magazine shafts are formed in the lower region by means of vertical shaft walls which by virtue of their dimensions receive a vertical row of cigarettes. At the lower ends, cigarette groups corresponding to the content of a cigarette pack are pushed out of the magazine or out of the magazine shafts. The cigarette groups formed in this way are delivered to the packaging units via conveyors (cigarette turret, pocket chain or the like).

The check to ascertain whether the cigarettes have been constructed correctly is mainly carried out after the formation of the cigarette groups in the region of the cigarette turret. However, it has also already been proposed to conduct the test of the cigarettes and separate out any defective cigarettes in the region of the magazine.

SUMMARY OF THE INVENTION

Starting from this, the object on which the invention is based is to carry out the cigarette test reliably in the region of the magazine by means of simple, effective measures.

To achieve this object, the packaging machine according to the invention or its magazine is characterized in that the test members, especially optoelectrical sensors, are arranged in the shaft walls of the magazine, which are made in appropriate (greater) thickness.

Preferably, for carrying out the tests, luminous diodes are used as transmitters and phototransistors as receivers. These are of very small constructional size and can be arranged in the shaft walls of the magazine, in such a way that they are directed towards the outer surface of the cigarettes, specifically at the ends of these. Accordingly, the sensors are preferably arranged in the vertical lateral regions of the shaft walls. The test proceeds in such a way that, if there is a deficient tobacco content or a missing filter, stronger light reaches the phototransistors.

The sensors, especially receivers, can be arranged in sealed-off blind holes in the shaft walls or in a cavity within these. The shaft walls consist of a transparent material, at least in the region of the sensor arrangement. The sensors can thus be accommodated in sealed-off cavities, avoiding soiling and consequent impairing of the test accuracy.

According to the invention, several, especially two layers of cigarettes are tested in the magazine shafts during the phase when the cigarettes moved downwards intermittently are stationary. In order to ascertain irregular defects in the tobacco content reliably, according to a further proposal sensors are arranged in the shaft walls on both sides of a magazine shaft, so that the cigarettes undergo testing from both sides.

Transmitters (luminous diodes) are preferably arranged in front of the end faces of the cigarettes, for example in a magazine front waLl and/or magazine rear wall. Thus, the light test is carried out on the cigarettes "diagonally". For this purpose, the magazine front wall or magazine rear wall can be designed completely or partially, especially in the region of a separate test strip, as a hollow body for receiving the sensors and other electrotechnical equipment.

The invention can advantageously be used in an apparatus according to German patent application Ser. No. P 36 30 735.7.

Further features of the invention relate to the design of the magazine and to the arrangement of the test members. Exemplary embodiments of the invention are explained in more detail below with reference to the drawings. In these:

FIG. 1 shows, in cut-out form, a vertical section through the lower region of a magazine, FIG. 2 shows a horizontal section through the detail according to FIG. 1, FIG. 3 shows another exemplary embodiment of a magazine in a vertical section in the longitudinal direction of the cigarettes, FIG. 4 shows a side view of the exemplary embodiment of FIG. 3, FIG. 5 shows a horizontal section through the magazine in the embodiment according to FIGS. 3 and 4, and FIG. 6 shows a detail of a further exemplary embodiment of the magazine, namely a horizontal section.

DETAILED DESCRIPTION OF PREFERRED EMBODIMENTS

Figure 3:
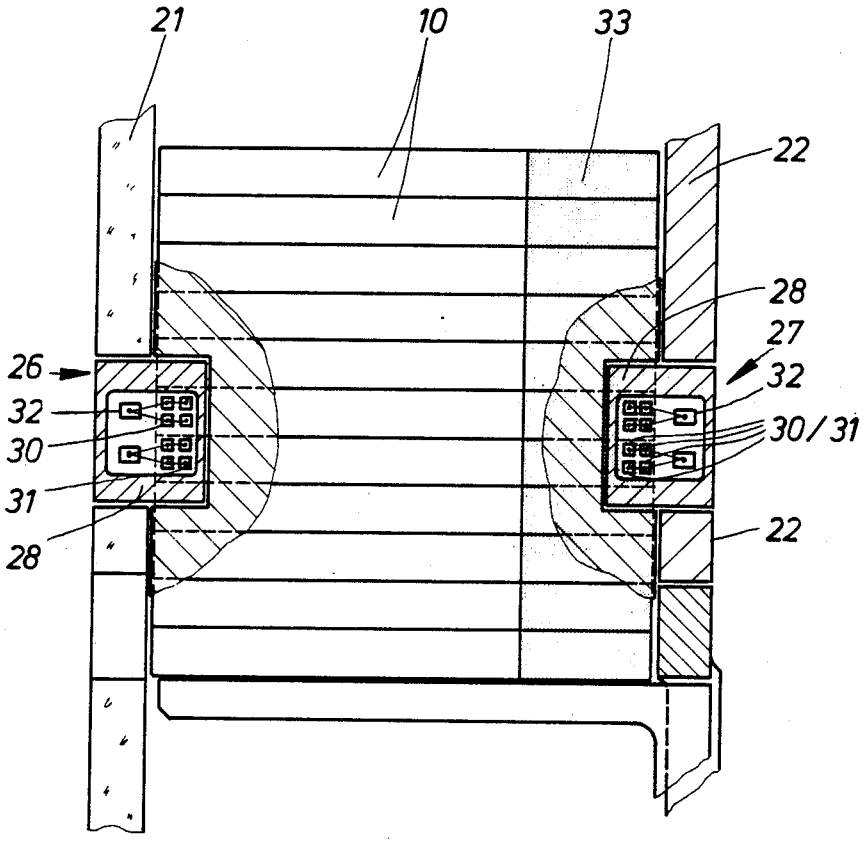

The details shown in the drawings are part of a packaging machine for cigarettes 10. They relate particularly to the design of a magazine 11. Packaging machines for cigarettes 10 are conventionally equipped with a magazine 11, namely a container which receives a stock of aligned cigarettes 10. Magazines of this type are generally known and are identical in terms of their basic design.

The lower region of the magazine 11 consists of a plurality of magazine shafts 12, the width of which corresponds approximately to the diameter of a cigarette 10. The magazine shafts 12 are divided off from one another by vertical shaft walls 13. Each magazine shaft 12 contains a vertical row of cigarettes 14 comprising cigarettes 10 arranged above and close up against one another. These are conveyed downwards under their own weight in the magazine shafts 12 and are finally pushed out of the magazine shafts 12 in groups of two cigarettes 10 at a time in their longitudinal direction. The number of cigarettes 10 pushed out of the magazine shafts 12 simultaneously corresponds to the content of the cigarette pack.

Figure 5:
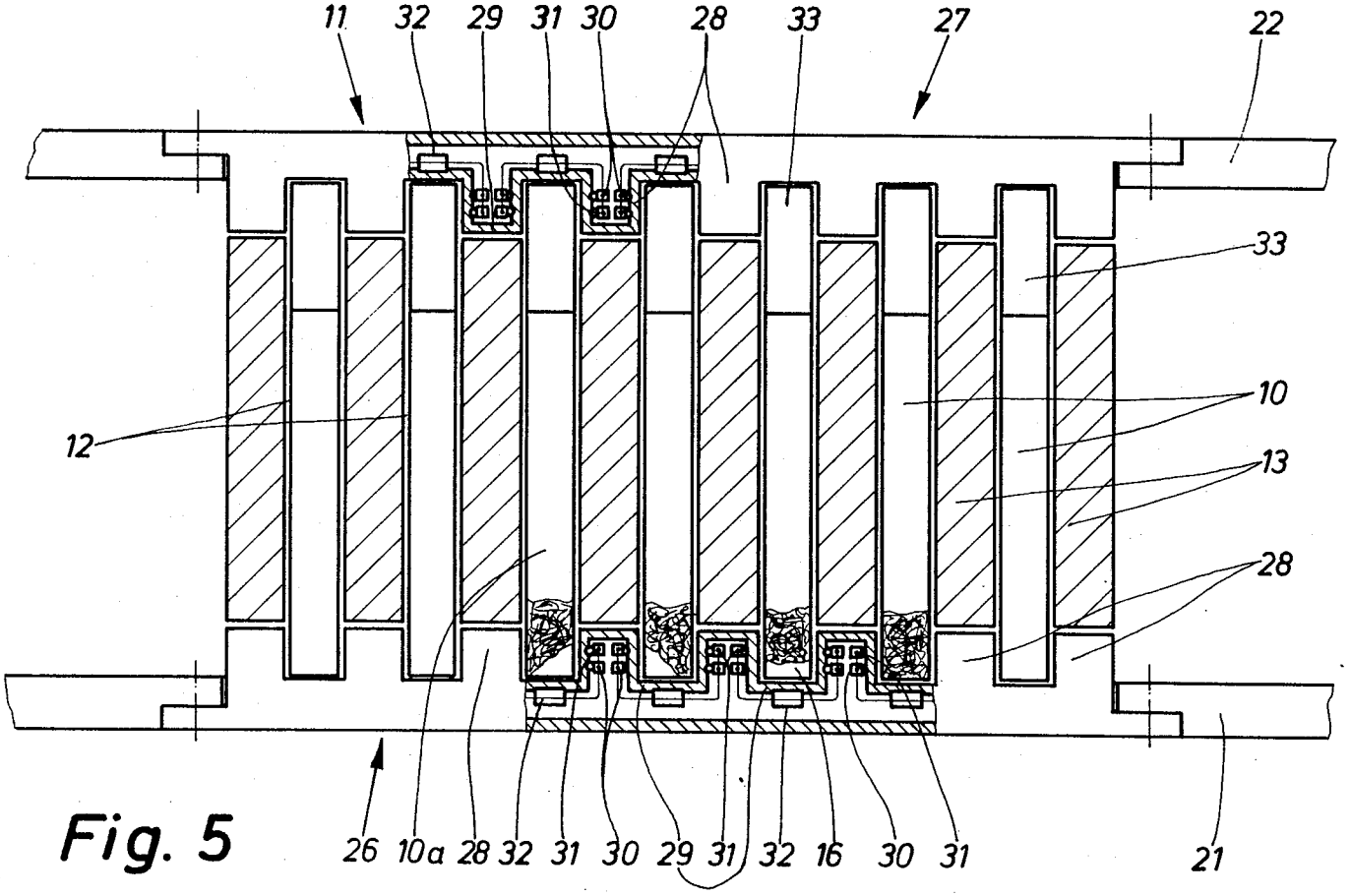
Figure 6:
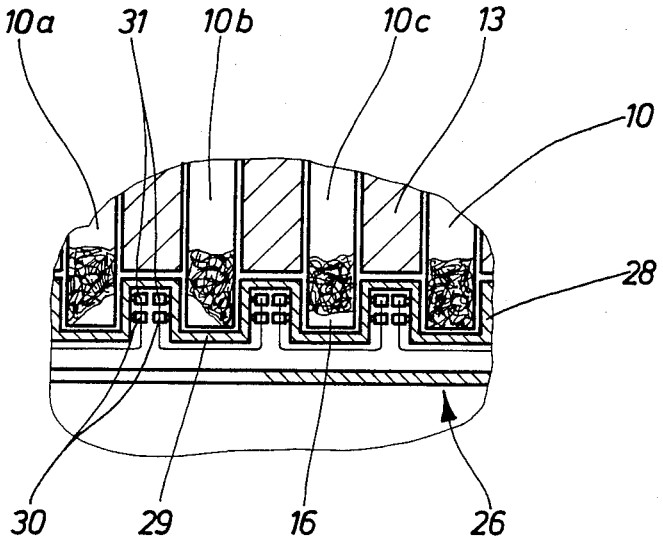

The cigarettes 10 are checked within the magazine shafts 12 to ascertain whether they are correctly constructed. In particular, the test must be conducted to determine whether the tobacco content 15 is complete in the region of the free ends or end faces of the cigarettes 10. FIGS. 2, 5, and 6 show examples of defective cigarettes 10*a*, 10*b*, 10*c* and 10*d*. In each of these there is a gap 16 in the tobacco at the ends, this gap being of a different shape in each case.

In order to identify the defective cigarettes 10*a* . . . 10*d* and separate them out in response to an error signal, test members, in particular optoelectrical sensors, are arranged in the shaft walls 13. For this purpose, the shaft walls 13 are made of greater thickness than shaft walls of conventional magazines.

The cigarette test is conducted optoelectrically. For this purpose, sensors, specifically receivers 17 and 18, are arranged in the shaft walls adjacent to the cigarette ends and consequently at the vertical edges of the shaft walls 13. These are phototransistors which react to light differences.

(Photo-)transmitters 19, especially luminous diodes, can be assigned to the receivers 17, 18. However, in the exemplary embodiment of FIGS. 1 and 2, only receivers 17, 18 are arranged in the shaft walls 13. The receiving side 20 of these faces the end region of the cigarette 10 or 10*a*, 10*b*, . . . to be tested. The light necessary for the cigarette test enters via the end faces of the cigarettes 10, 10*a*, . . . For this purpose, the front wall 21 and, if appropriate, the rear wall 22 extending transversely relative to the shaft walls in the exemplary embodiment of FIGS. 1 and 2 are produced completely or partially from transparent material, for example, plastic. As a result, outside light can reach the end faces of the cigarettes 10, 10*a*, . . . via the front wall 21. If the cigarette 10 is constructed correctly, that is to say without a gap 16 in the tobacco, the receiver 17, 18 will be subjected to relatively little light. In contrast, if there is a gap 16 in the tobacco, the receiver 17, 18 absorbs more light and triggers an error signal.

The differing shape of the gap 16 in the tobacco is taken into account by testing each cigarette 10 from both sides as a result of an appropriate arrangement of receivers 17 and 18. The test on the cigarettes 10 is conducted when the cigarettes 10 moved downwards in stages are in the position of rest. In the present exemplary embodiment, two cigarettes 10 at a time are pushed out of each magazine shaft 12. Thus, the stage of movement of the cigarettes 10 in the magazine shafts 12 amounts to 2 cigarettes. The cigarettes are tested above a pushing-out plane 23 for these. Accordingly, two receivers 17 pointing in the same direction are arranged above one another, specifically level with every two cigarettes to be tested. Above them, a further two receivers 18 are pointed in the opposite direction. Consequently, during two successive stationary phases of the cigarettes, both sides are tested, so that even irregular gaps 16 in the tobacco can be identified.

The sensors can be arranged in various ways within the shaft walls 13. In the exemplary embodiment according to FIGS. 1 and 2, blind holes 24, each receiving a receiver 17, 18 , are formed in the shaft walls. The arrangement of the sensors in the blind holes 24 is selected so that the receiving side 20 faces the closed side of the blind hole 24. Thus, the sensors are accommodated so as to be protected against mechanical stress and soiling. At the same time, the shaft walls 13 are made transparent, for example of plastic, completely or in part regions.

In the exemplary embodiment of FIGS. 1 and 2, the front wall 21 is designed so that it projects into the magazine shafts 12 by means of rib-like projections 25 and thus rests against the end faces of the cigarettes 10, 10*a*, . . . To guarantee that the cigarettes will slide down without tilting, during a movement phase of the cigarettes the front wall 21 is lifted off from these or from the shaft walls 13 (the dot-dash line in FIG. 2). The front wall 21 is consequently arranged so as to be moveable intermittently or in a pulsating manner.

Figure 4:
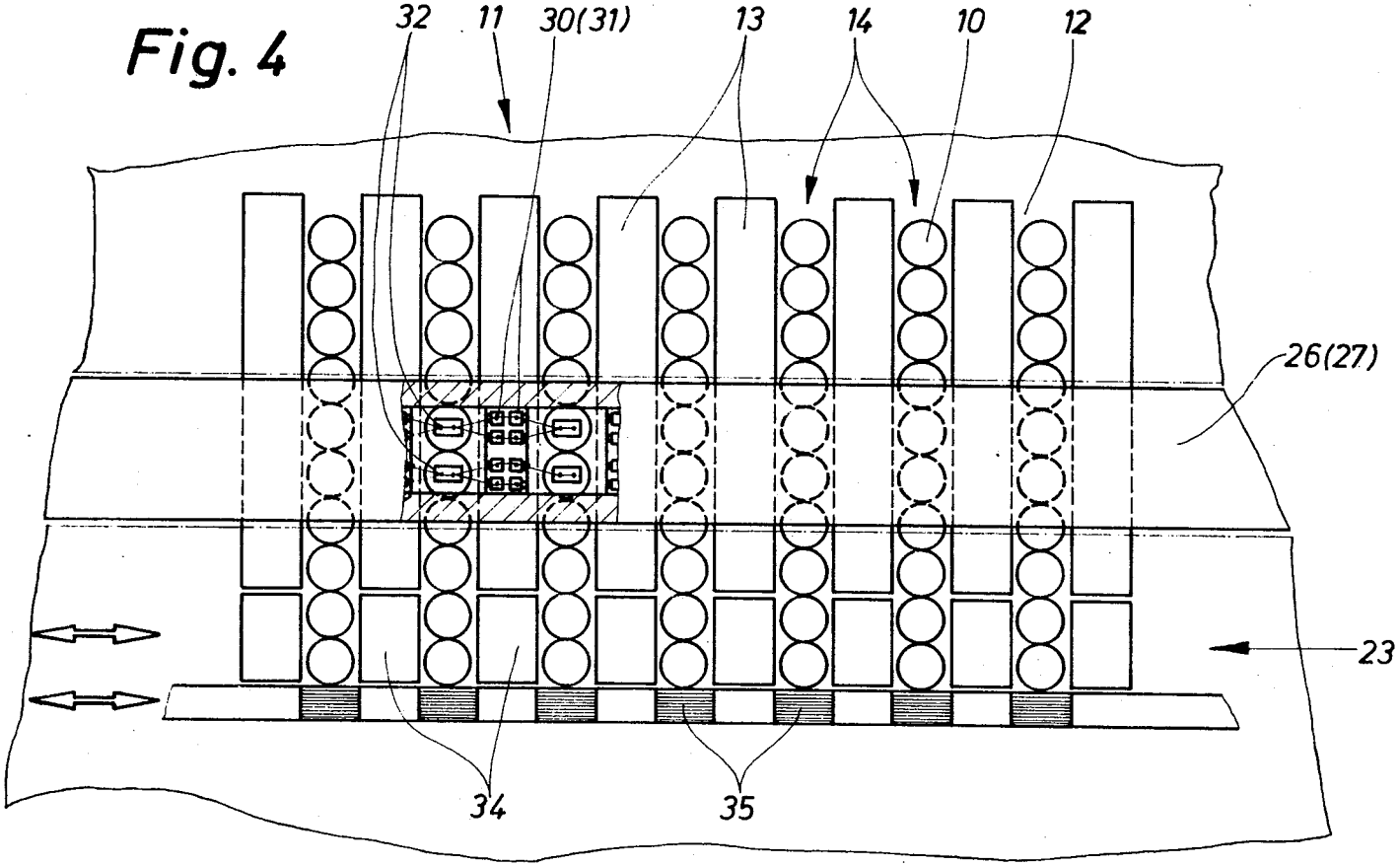

In the exemplary embodiment according to FIGS. 3, 4 and 5, the magazine 11 has a new design in a part region in comparison with previous embodiments. In order to accommodate the sensors and other electrotechnical or electronic equipment for testing the cigarettes 10, a test strip 26 or 27 is arranged in the region of the front wall and/or in the region of the rear wall 22. This test strip is part of the front wall 21 or rear wall 22 and is connected releasably as a single unit to the remaining part of the front wall 21 or rear wall 22 and accordingly is inserted into a recess in this. The test strip 26, 27 as a whole is designed as a hollow body.

As illustrated, at least in the region of the test strip 26, 27 the shaft walls 13 are of a width less than the length of the cigarettes. In the region of the test strips 26, 27, a rib-like projection 28 of these fits positively into the depressions formed in this way between adjacent rows of cigarettes 14. This projection forms, together with the remaining part of the test strip 26, 27, a common workpiece and a continuous hollow body. This is made comb-like as a result of the projections 28. The ends of the cigarettes 10 are located between adjacent projections 28.

The sensors arranged some within the hollow projection 28 and some in the region of an inner wall 29 of the test strip 26, 27. In keeping with the test method described, two receivers 30 and 31 are located on each side of the projection 28. Furthermore, here too, the principle of testing the ends of the cigarettes from two opposite sides is put into effect, and as a result of the dimensions of the projections, on the one hand, and the small size of the sensors, on the other hand, two sensors for testing adjacent cigarettes are located in each case opposite one another in the same transverse plane. As a result of the two receivers 30 and 31 assigned to each cigarette 10 on the same side, the test sensitivity and therefore its accuracy are increased.

In this exemplary embodiment, the transmitters 32 (luminous diodes) are arranged in front of the end faces of the cigarettes 10 within the test strip 26, 27, and in particular on the inner walls 29. For carrying out the test, the test strip 26, 27 is produced as a whole, or at least in the region of the projections 28 and of the inner wall 29, from transparent material. Here too, all the sensitive optical or electrotechnical devices are, at all events, accommodated in a closed encased cavity.

Whereas a test strip 26 checks the cigarettes 10 for any gaps 16 in the tobacco in the way already described, the test strip 27 serves for checking the cigarettes 10 for the presence of a filter 33. In contrast to the representation in the drawing, it is sufficient for testing the filter 33 if only one receiver 30 or 31 is provided for each cigarette.

As is evident from FIG. 4, the test strip 26, 27 is arranged in such a way that two cigarettes located above one another in one magazine shaft 12 are tested simultaneously, and , as shown, two receivers 30, 31 are assigned above one another to each cigarette end. This means that four receivers 30, 31 are provided for each side of a cigarette (at its end), specifically being arranged in pairs above and next to one another.

FIG. 6 shows a small cut-out from a magazine 11 with a test strip 26, 27. The arrangement of the receivers 30, 31 in the region of the projections 28 corresponds to the exemplary embodiment described above. In the proposal according to FIG. 6, no transmitters (luminous diodes) are used. Here, the light is transmitted to the ends of the cigarettes 10 and consequently to the receivers 30, 31 via the completely transparent test strip 26, 27.

The test members (sensors) can be used in the way described in conventional, generally known cigarette magazines, but with the shaft walls being of a correspondingly greater thickness. However, this solution can be put to especially advantageous use in a magazine according to patent application Ser. No. P 36 20 735.7. In the exemplary embodiment illustrated, the magazine 11, in terms of the way in which any defective cigarettes are separated out, corresponds to the magazine according to the abovementioned earlier Patent Application. The details shown in the drawings are integral parts of the test unit of the earlier Patent Application, that is to say a unit with magazine shafts and shaft walls, which is built into the magazine. Accordingly, for separating out defective cigarettes 10*a*, 10*b*, . . . , in the illustrated exemplary embodiment too there are guide and supporting members in the region of the pushing-out plane 23 and comb webs 34 and supporting webs 35 which are movable relative to one another in the transverse direction, specifically in the way described in the earlier Patent Application. The further details of the magazine not shown in full in the drawings can also correspond to that of patent application Ser. No. P 36 20 735.7.

What is claimed is:

1. Magazine for stocking cigarettes in a cigarette-packaging machine, the magazine being subdivided, at least in a lower region thereof, by shaft walls into magazine shafts each for receiving a vertical row of cigarettes, said magazine comprising test members for testing the cigarettes for a correct tobacco content and presence of a filter; wherein said test members comprise optoelectrical sensors (17, 18; 30, 31) located in said shaft walls (13) of the magazine (11), said shaft walls (13) having a thickness sufficiently large to accommodate said sensors.

2. Magazine according to claim 1, characterized in that the sensors (17, 18; 30, 31) are arranged in the shaft walls (13), adjacent to at lest one end region of the cigarettes (10, 10*a*, 10*b*, . . .), in the region of vertical side edges of the shaft walls (13).

3. Magazine according to claim 2, characterized in that each sensor in the shaft walls (13) faces the end region of a particular cigarette (10, 10*a*, 10*b*, . . .) to be tested.

4. Magazine according to claim 1, characterized in that said sensors comprise transmitters (19, 32) and receivers (17, 18; 30, 31) which are assigned to one another and which are arranged in the shaft walls (13) and in a front wall (21) or rear wall (22) of the magazine (11), said front and rear walls extending transversely relative to said shaft walls.

5. Magazine according to claim 4, characterized in that the shaft walls (13), the front wall (21) and rear wall (22) consist of transparent material, at least in the region of the sensor.

6. Magazine according to claim 5 characterized in that the sensors are arranged in closed blind holes (24) in the transparent shaft walls (13) and front wall (21) or rear wall (22).

7. Magazine according to claim 1, characterized in that said sensors are arranged in said shaft walls (13) for testing the cigarettes from two sides located opposite one another.

8. Magazine according to claim 4, characterized in that, in the shaft walls, several sensors are arranged for simultaneously checking at least two cigarettes of a cigarette group which are located above one another in each magazine shaft.

9. Magazine according to claim 8, characterized in that four receivers (17, 18), are arranged in each case above one another and directed in opposite pairs in the edge region of each shaft wall (13).

10. Magazine according to claim 4 characterized in that the transmitters (19) are arranged in the region of the front wall (21) or rear wall (22), and the receivers (17, 18) are arranged in the region of the shaft walls (13).

11. Magazine according to claim 4, characterized in that two receivers (30, 31), taking effect on opposite sides, are arranged next to one another in the shaft walls (13).

12. Magazine according to claim 4, characterized in that two receivers (30, 31) assigned to the same cigarette are arranged next to one another in the shaft walls (13) and parallel to the longitudinal direction of the cigarettes (10).

13. Magazine according to claim 4, characterized in that, at least in the region of the sensors, the front wall (21) and rear wall (22) contain transversely directed hollow test strips (26, 27), the sensors and associated electrical leads being disposed inside the test strips (26, 27).

14. Magazine according to claim 13, characterized in that the test strips (26, 27) of the front wall (21) and rear wall (22) are equipped with hollow projections (28) which correspond in thickness to that of the shaft walls (13), which project into the region of the shaft walls (13) in alignment therewith, and which receive the receivers (30, 31), the shaft walls (13) having a smaller width, in the region of the test strips (26, 27), than the length of the cigarettes.

* * * * *